US008857386B2

(12) United States Patent
Kuhlbach et al.

(10) Patent No.: US 8,857,386 B2
(45) Date of Patent: Oct. 14, 2014

(54) INTERNAL COMBUSTION ENGINE WITH LIQUID COOLING

(75) Inventors: Kai Sebastian Kuhlbach, Bergisch Gladback (DE); Guenter Bartsch, Gummersbach (DE); Marcus Klaar, Wermelskirchen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 399 days.

(21) Appl. No.: 13/251,008

(22) Filed: Sep. 30, 2011

(65) Prior Publication Data

US 2012/0085299 A1 Apr. 12, 2012

(30) Foreign Application Priority Data

Oct. 8, 2010 (DE) ..... 10 2010 038 055

(51) Int. Cl.

| | |
|---|---|
| ***F02F 1/36*** | (2006.01) |
| ***F02F 1/42*** | (2006.01) |
| ***F02F 1/24*** | (2006.01) |
| ***F02F 1/40*** | (2006.01) |

(52) U.S. Cl.

CPC ..... *F02F 1/40* (2013.01); *F02F 1/4264* (2013.01); *F02F 1/243* (2013.01)

USPC ..... 123/41.82 R; 60/321; 60/323; 60/599

(58) Field of Classification Search

CPC ..... F02F 1/243; F01N 3/046; F01N 13/004

USPC ..... 123/41.82 R, 193.5; 60/599, 321, 323

See application file for complete search history.

(56) References Cited

U.S. PATENT DOCUMENTS

| | | | | |
|---|---|---|---|---|
| 2,710,602 | A * | 6/1955 | Maybach | 123/41.76 |
| 3,948,052 | A * | 4/1976 | Merkle et al. | 60/605.1 |
| 5,868,106 | A * | 2/1999 | Poropatic et al. | 123/41.82 R |
| 6,295,963 | B1 * | 10/2001 | Kollock et al. | 123/193.5 |
| 6,513,506 | B1 | 2/2003 | Ito et al. | |
| 7,784,442 | B2 * | 8/2010 | Lester et al. | 123/193.5 |
| 8,209,980 | B2 * | 7/2012 | Takagawa et al. | 123/193.5 |
| 8,459,024 | B2 * | 6/2013 | Koch | 60/321 |
| 2006/0196453 | A1 | 9/2006 | Yamada et al. | |
| 2008/0308050 | A1 | 12/2008 | Kuhlbach et al. | |
| 2009/0084332 | A1 | 4/2009 | Nagafuchi | |
| 2009/0165298 | A1 * | 7/2009 | Nagafuchi | 29/888.06 |

FOREIGN PATENT DOCUMENTS

| | | | |
|---|---|---|---|
| DE | 102008011257 | A1 | 9/2009 |
| EP | 1283345 | A2 | 2/2003 |
| EP | 1384857 | A2 | 1/2004 |
| EP | 1722090 | A2 | 11/2006 |
| JP | 2006063851 | A * | 3/2006 |

* cited by examiner

*Primary Examiner* — Noah Kamen

(74) *Attorney, Agent, or Firm* — Julia Voutyras; Alleman Hall McCoy Russell & Tuttle LLP

(57) ABSTRACT

Example embodiments for reducing thermal load in one or more exhaust gas lines are provided. One embodiment includes an internal combustion engine with liquid cooling, comprising at least one exhaust gas line, at least one coolant jacket, and a common boundary wall separating the at least one exhaust gas line and the at least one coolant jacket, wherein the common boundary wall includes a surface structure provided on sides of the coolant jacket in at least one locally limited region. In this way, the surface structure on the sides of the coolant jacket may increase heat transfer to reduce thermal loading.

18 Claims, 6 Drawing Sheets

INTERNAL COMBUSTION ENGINE WITH LIQUID COOLING

RELATED APPLICATIONS

The present application claims priority to German Patent Application No. 102010038055.5, filed on Oct. 8, 2010, the entire contents of which are hereby incorporated by reference.

FIELD

The disclosure relates to an internal combustion engine with liquid cooling.

BACKGROUND AND SUMMARY

An internal combustion engine is used as a drive for motor vehicles. Some engines may include a turbocharger to boost the engine in order to allow for a smaller displacement engine. Liquid cooling systems are of major relevance in connection with boosted internal combustion engines. For example, the endeavor to achieve as close-fitting a packaging of the engine and turbocharger as possible basically result in higher thermal loading upon the internal combustion engine, in particular upon individual components and assemblies.

The cylinder head of a turbocharged internal combustion engine is subjected to greater thermal stress than the cylinder head of naturally aspirated engine because of the higher exhaust gas temperatures produced as a result of the turbocharger.

In order to implement as close-fitting a packaging as possible in the engine space, the aim is to have a compact type of construction, where, it is considered expedient to bring together the exhaust gas lines for discharging the exhaust gases so as to form an exhaust manifold inside the cylinder head, that is to say to integrate the manifold in the cylinder head. However, a cylinder head designed in this way is subjected to higher thermal loads than a conventional cylinder head equipped with an external manifold and therefore presents increased cooling requirements.

In order to minimize fuel consumption, in addition to the development of consumption-optimized combustion methods, measures for weight reduction are in this case at the forefront. The use of alternative materials is also expedient, where the aluminum preferably used, for example, for cylinder heads leads to a marked weight reduction, but is less capable of withstanding thermal load. This leads to an increased cooling demand and therefore to increased cooling requirements.

The heat released during combustion as a result of the exothermal chemical combustion of the fuel is discharged partially via the walls on the cylinder head which delimit the combustion space, and partially, via the exhaust gas stream, to the adjacent components and into the surroundings. In order to keep the thermal load upon the cylinder head within limits, part of the heat flow introduced into the cylinder head has to be extracted from the cylinder head again. The heat quantity discharged into the surroundings from the surface of the internal combustion engine by radiation and heat conduction is not adequate for efficient cooling, and therefore the cylinder head is often equipped with liquid cooling with which cooling inside the cylinder head is brought about by means of forced convection.

Liquid cooling results in the cylinder head being equipped with a coolant jacket, that is to say the arrangement of coolant ducts carrying the coolant through the cylinder head, thus making the cylinder head construction have a complex structure. For this case, on the one hand, the strength of the mechanically and thermally highly loaded cylinder head is weakened by the coolant ducts being introduced. On the other hand, unlike air cooling, the heat has to be conducted first to the cylinder head surface in order to be discharged. The heat is transferred, even inside the cylinder head, to the coolant, usually water mixed with additives. The coolant is in this case conveyed by means of a pump arranged in the cooling circuit, so that it circulates in the coolant jacket. The heat transferred to the coolant is thereby discharged from inside the cylinder head and is extracted from the coolant again in a heat exchanger.

However, even a liquid-cooled cylinder head may overheat. Thus, the cooling of the cylinder head described in EP 1 722 090 A2 proves inadequate in practice, and, particularly in the region where the exhaust gas lines converge into one common exhaust gas line, thermal overloading may occur which can be reflected, for example, in the form of material fusions.

In order to prevent this, in an internal combustion engine equipped with a cylinder head according to EP 1 722 090 A2, an enrichment ($\lambda<1$) is carried out whenever high exhaust gas temperatures are to be expected. In this case, more fuel is injected than can be burnt by means of the air quantity provided, the additional fuel likewise being heated and evaporated, so that the temperature of the combustion gases falls. However, this procedure is considered a disadvantage in energy terms, particularly with regard to the fuel consumption of the internal combustion engine, and with regard to pollutant emissions. In particular, the necessary enrichment may not make it possible to operate the internal combustion engine, as would be optimal, for example, for an exhaust gas retreatment system provided.

Overheating may become noticeable in that the coolant located in the coolant jacket evaporates in places. In the places where the coolant evaporates, a thin gas layer is formed which covers the inner wall of the coolant jacket, that is to say the boundary wall, and greatly reduces the heat transfer at this location. The wall material lying beneath the layer of gaseous coolant may overheat and fuse. Furthermore, gas bubbles formed may abruptly implode, if the vapor pressure is overshot or the temperature decreases. The latter leads to material damage similar to that resulting from cavitation. Moreover, overheating also impairs the properties of the coolant, that is to say its ability to cool or to absorb heat. The phenomena described above occur in thermally highly loaded regions of the boundary wall which is arranged between an exhaust gas-carrying line and the coolant jacket.

Additionally, turbocharger turbines provided in the engine may be liquid cooled. So that more cost-effective materials can be used for producing the turbine, the turbine may be equipped with liquid cooling which greatly reduces the thermal load upon the turbine or turbine casing by the hot exhaust gases and consequently allows the use of materials less capable of withstanding thermal load.

To implement cooling, the turbine casing is often provided with at least one coolant jacket. The casing may be is a casting and the coolant jacket formed during the casting operation as an integral part of a monolithic casing, the casing may be constructed in a modular manner, and a cavity, which serves as a coolant jacket, formed during assembly.

A turbine configured according to the last-mentioned concept is described, for example, in German laid-open publication DE 10 2008 011 257 A1. Liquid cooling of the turbine is implemented in that the actual turbine casing is provided with cladding, so as to form between the casing and the at least one cladding element arranged at a distance a cavity into which coolant can be introduced. The casing extended by the cladding then comprises the coolant jacket, and it is therefore also considered as the casing of the turbine in the context of the present disclosure. EP 1 384 857 A2 likewise discloses a turbine, the casing of which is equipped with a coolant jacket which is acted upon with seawater. The turbine casing is a casting formed in one piece.

What has been said with regard to overheating in connection with the cylinder head also applies in a similar way to the turbine casing, such that traditional liquid cooling systems of turbines may be subject to local regions of thermal overload resulting in overheating and possible damage to the turbine.

The inventors have recognized the issues with the above approaches and offer a system herein to at least partly address them. In one embodiment, an internal combustion engine is provided. The engine comprises at least one exhaust gas line, at least one coolant jacket, and a common boundary wall separating the at least one exhaust gas line and the at least one coolant jacket, wherein the common boundary wall includes a surface structure provided on sides of the coolant jacket in at least one locally limited region.

In this way, the coolant jacket has a boundary wall which, in contrast to previous boundary walls, is not designed to be even, but, instead, to be deliberately uneven in places, in that a surface structure is introduced into the wall on the coolant side. By a surface structure being introduced, the area available for heat transfer is increased. Moreover, the velocity near the wall rises since the surface structure generates turbulences. The two effects improve, that is to say intensify, the heat transfer. The introduction of heat from the wall into the coolant and therefore the cooling capacity increase.

In another embodiment, a system for reducing thermal loading comprises a cylinder head including a plurality of exhaust lines, the plurality of exhaust lines merging together in one or more confluence regions, an exhaust manifold integrated into the cylinder head and coupled to the plurality of exhaust lines, a coolant jacket integrated in the cylinder head and separated from the plurality of exhaust lines by one or more boundary walls, and at least one element positioned only on sides of the one or more boundary walls that face into the coolant jacket, the at least one element located only in the one or more confluence regions.

If appropriate, as a result of improved cooling, an enrichment of the fuel/air mixture with the aim of lowering the exhaust gas temperature may be dispensed with. This proves advantageous particularly with regard to the fuel consumption and the emission behavior of the internal combustion engine. Furthermore, more freedom in controlling the internal combustion engine arises, since possible enrichment for lowering the exhaust gas temperature in the context of engine control is avoidable.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
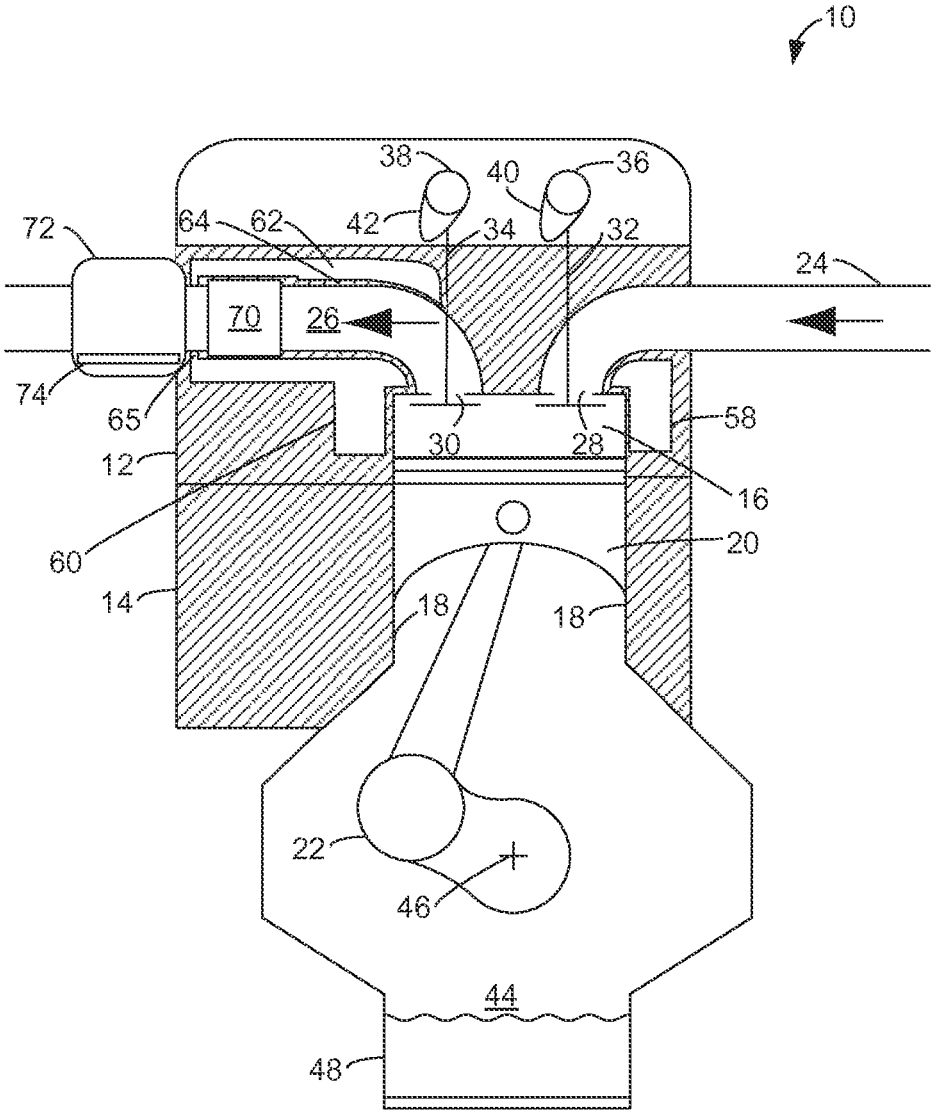
FIG. 1 shows a schematic diagram of one cylinder of an engine according to an embodiment of the present disclosure.
Figure 2:
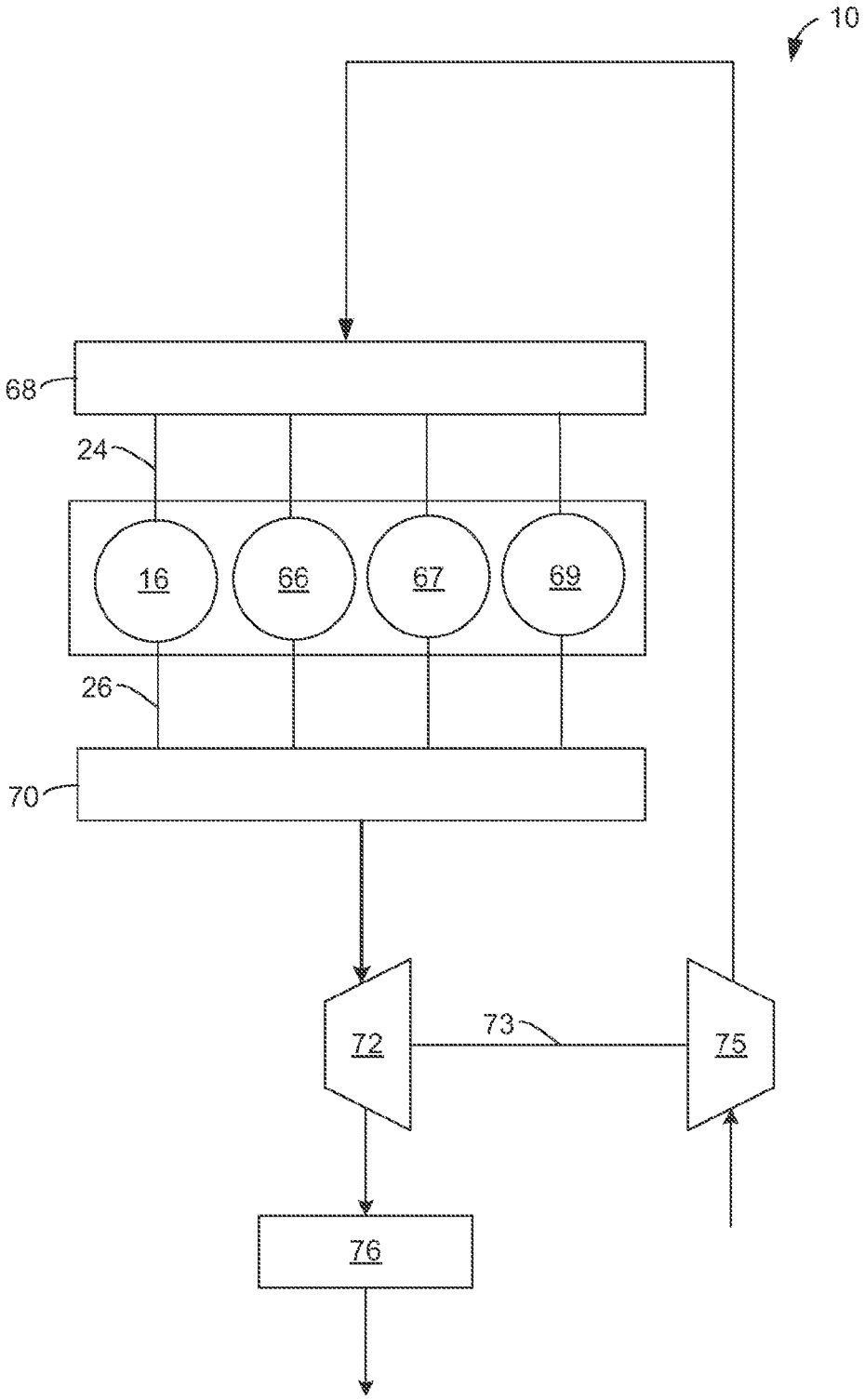
FIG. 2 shows a schematic diagram of a multi-cylinder engine including the cylinder of FIG. 1.
Figure 3:
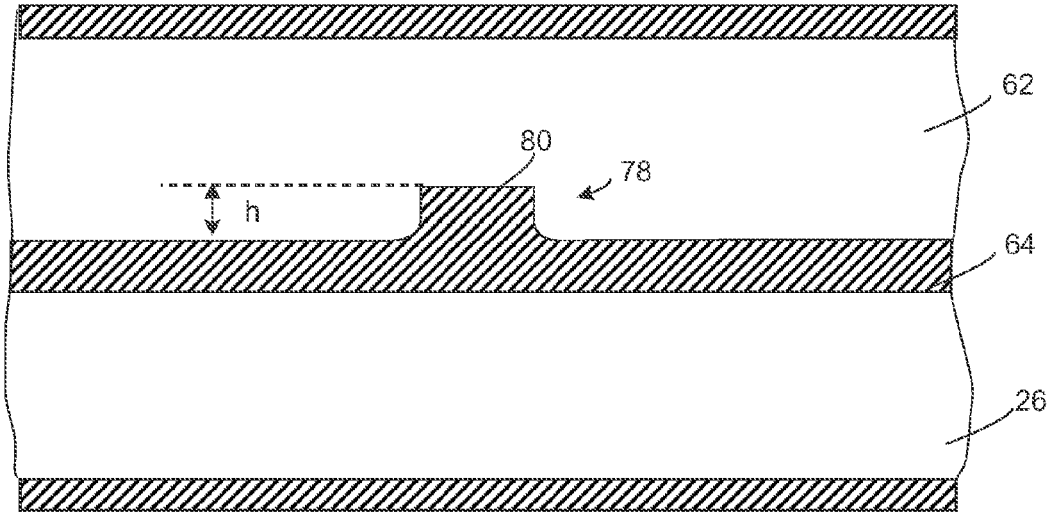
FIG. 3 shows a diagrammatic illustration of a detail of the liquid cooling of a first embodiment of the internal combustion engine.
Figure 4:
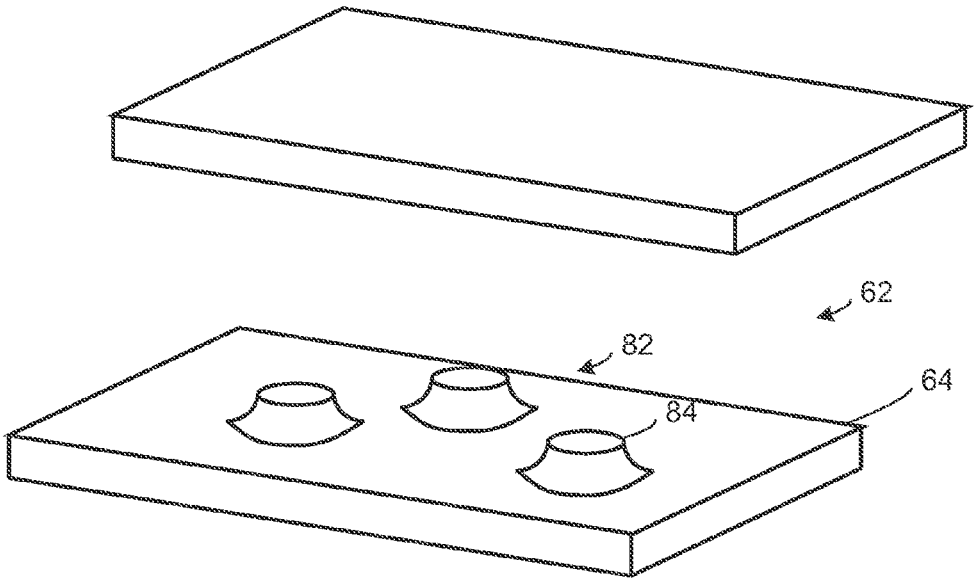
FIG. 4 shows a perspective illustration of a detail of the coolant jacket of the liquid cooling illustrated in FIG. 3.
Figure 5:
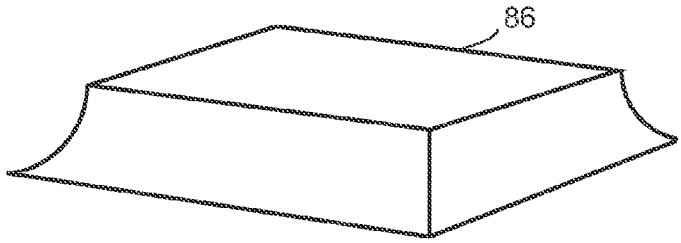
FIG. 5 shows a perspective illustration of a detail of the coolant jacket of a second embodiment of the liquid cooling.
Figure 6:
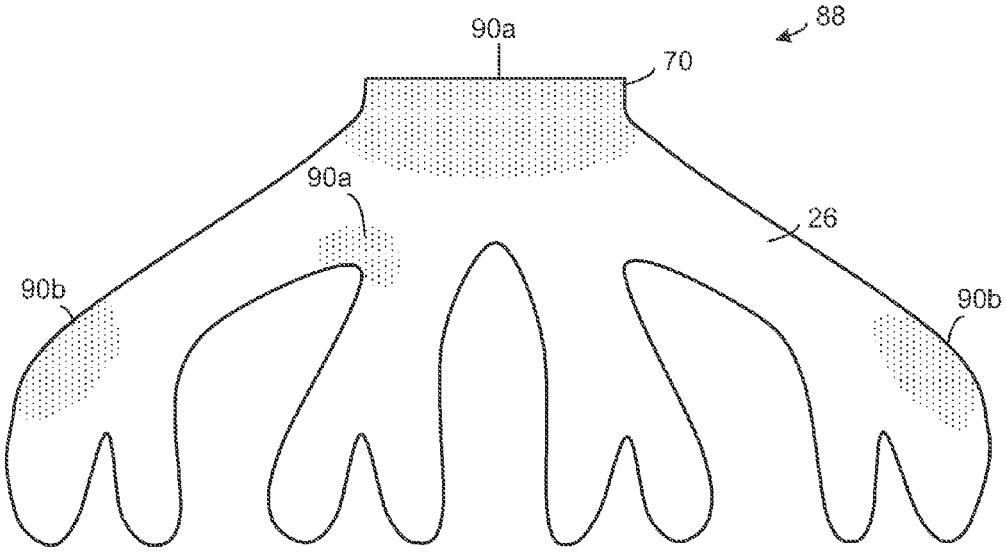
FIG. 6 shows a top view of the sand core of the exhaust gas lines integrated into a cylinder head of an internal combustion engine.
Figure 7:
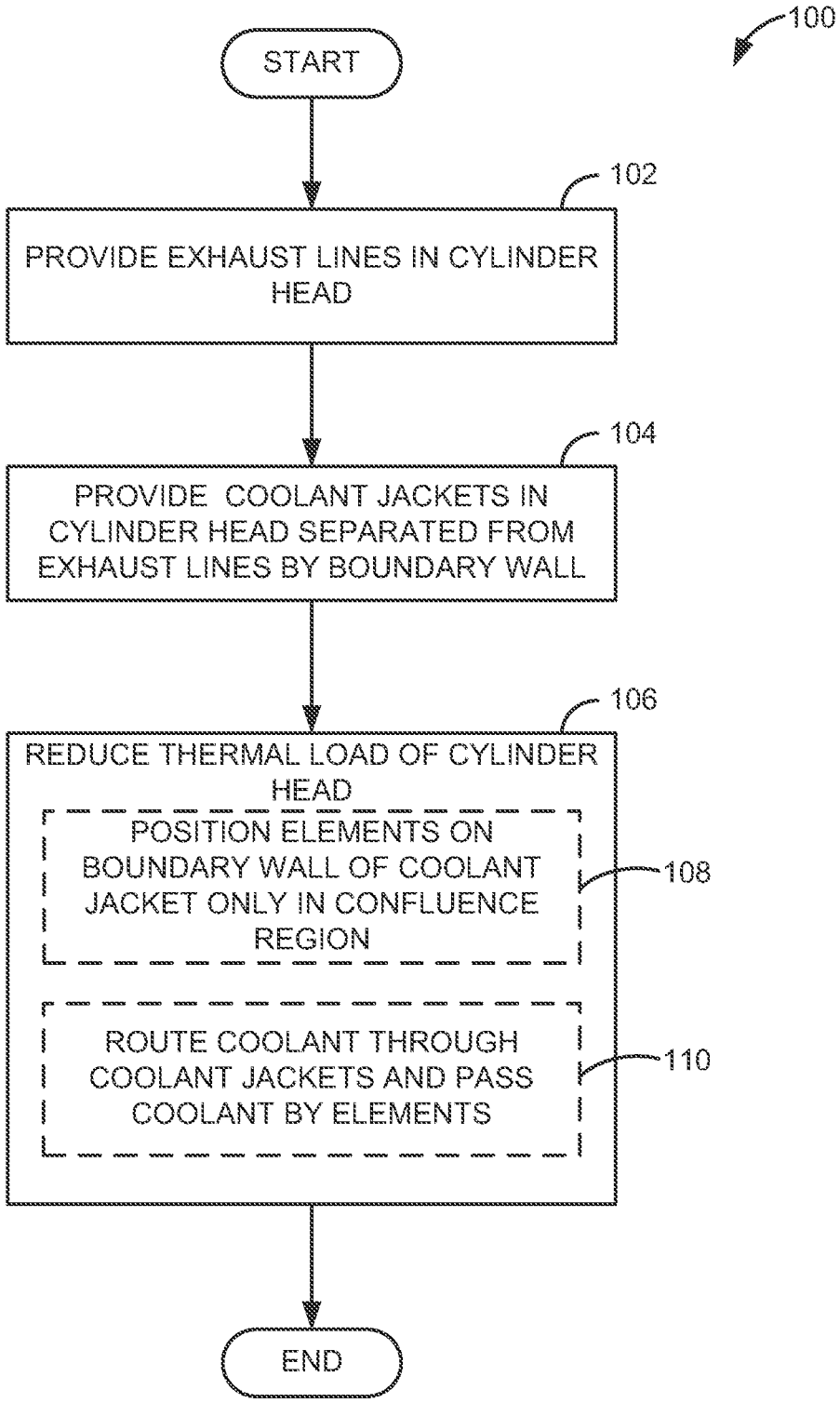
FIG. 7 is a flow chart illustrating a method for reducing thermal load in a cylinder head according to an embodiment of the disclosure.

The cylinder head and/or turbine of an engine may be prone to local areas of high thermal loading that may lead to material weakness or damage. A liquid cooling arrangement may be provided in the cylinder head and turbine including coolant jackets configured with additional heat-transferring elements in the areas of high thermal loading. FIGS. 1 and 2 show schematic diagrams of an engine including a liquid cooling arrangement. FIGS. 3-5 show various perspectives of the heat-transferring elements, and FIG. 6 shows an illustration of an example sand core used to make the coolant jackets. FIG. 7 is a flow chart illustrating an example method for reducing thermal load using the liquid cooling arrangement.

FIG. 1 is a schematic diagram showing one cylinder 16 of a multi-cylinder engine 10, which may be included in a propulsion system of an automobile. The engine 10 includes a cylinder head 12 and a cylinder block 14 which are connected to one another at their assembly end sides so as to form a combustion chamber.

Combustion chamber (i.e. cylinder) 16 of engine 10 may include combustion chamber walls 18 with piston 20 positioned therein. Piston 20 may be coupled to crankshaft 22 so that reciprocating motion of the piston is translated into rotational motion of the crankshaft. Crankshaft 22 may be coupled to at least one drive wheel of a vehicle via an intermediate transmission system. Further, a starter motor may be coupled to crankshaft 22 via a flywheel to enable a starting operation of engine 10.

Combustion chamber 16 may receive intake air from an intake manifold (not shown) via intake line, or intake passage, 24 and may exhaust combustion gases via exhaust line, or exhaust passage, 26. Exhaust line 26 may be coupled to an exhaust manifold 70 leading to an overall exhaust passage, which in the depicted embodiment is integrated into cylinder head 12. Intake passage 24 and exhaust passage 26 can selectively communicate with combustion chamber 16 via inlet opening 28 and outlet opening 30 and respective intake valve 32 and exhaust valve 34. In some examples, combustion chamber 16 may include two or more intake valves and/or two or more exhaust valves.

During operation, each cylinder within engine 10 typically undergoes a four stroke cycle: the cycle includes the intake stroke, compression stroke, expansion stroke, and exhaust stroke. During the intake stroke, generally, the exhaust valve 34 closes and intake valve 32 opens. Air is introduced into combustion chamber 16 via intake passage 24, and piston 20 moves to the bottom of the cylinder so as to increase the volume within combustion chamber 16. The position at which piston 20 is near the bottom of the cylinder and at the end of its stroke (e.g. when combustion chamber 16 is at its largest volume) is typically referred to by those of skill in the art as bottom dead center (BDC). During the compression stroke, intake valve 32 and exhaust valve 34 are closed. Piston 20 moves toward the cylinder head so as to compress the air within combustion chamber 16. The point at which piston 20 is at the end of its stroke and closest to the cylinder head (e.g. when combustion chamber 16 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as a spark plug (not shown), resulting in combustion. During the expansion stroke, the expanding gases push piston 20 back to BDC. Crankshaft 22 converts piston movement into a rotational torque of the rotary shaft. Finally, during the exhaust stroke, the exhaust valve 34 opens to release the combusted air-fuel mixture to exhaust passage 26 and the piston returns to TDC. Note that the above is shown merely as an example, and that intake and exhaust valve opening and/or closing timings may vary, such as to provide positive or negative valve overlap, late intake valve closing, or various other examples.

A valve actuating device depicted in FIG. 1 comprises two camshafts 36 and 38, on which a multiplicity of cams 40, 42 are arranged. A basic distinction is made between an underlying camshaft and an overhead camshaft. This relates to the parting plane, that is to say assembly surface, between the cylinder head and cylinder block. If the camshaft is arranged above said assembly surface, it is an overhead camshaft, otherwise it is an underlying camshaft. Overhead camshafts are preferably mounted in the cylinder head, and are depicted in FIG. 1.

The cylinder head 12 is connected, at an assembly end side, to a cylinder block 14 which serves as an upper half of a crankcase 44 for holding the crankshaft 22 in at least two bearings, one of which is depicted as crankshaft bearing 46. At the side facing away from the cylinder head 12, the cylinder block 14 is connected to an oil pan 48 which serves as a lower crankcase half and which is provided for collecting and storing engine oil.

The heat released during combustion by the exothermic chemical conversion of the fuel is dissipated in part to the cylinder head 12 and the cylinder block 14 via the walls bounding the combustion chamber 16 and in part to the adjoining components and the environment via the exhaust gas flow. To reduce the thermal stress on the cylinder head 12, some of the heat flow introduced into the cylinder head 12 may be removed from the cylinder head 12 again.

Owing to the significantly higher heat capacity of liquids relative to air, significantly larger amounts of heat can be dissipated by a liquid cooling system than with an air cooling system, for which reason cylinder heads of the type in question are advantageously provided with a liquid cooling system.

Liquid cooling results in the cylinder head being provided with at least one coolant jacket, or the arrangement of coolant ducts which carry the coolant through the cylinder head, and this results in a cylinder head design with a complex structure. On the one hand, this means that the mechanically and thermally highly stressed cylinder head is weakened by the introduction of the coolant ducts. On the other hand, the heat does not first have to be conducted to the surface of the cylinder head in order to be dissipated, as with the liquid cooling system. The heat is released to the coolant, generally water containing additives, within the cylinder head itself. In this arrangement, the coolant is delivered by a pump arranged in the cooling circuit and thus circulates in the coolant jacket. In this way, the heat released to the coolant is dissipated from the interior of the cylinder head and removed from the coolant again in a heat exchanger.

Thus, cylinder head 12 may include one or more coolant jackets 58, 60, 62. As depicted in FIG. 1, coolant jacket 58 is located on an inlet side of cylinder head 12. Lower coolant jacket 60 is located between exhaust line 26 and the assembly end side of cylinder head 12, while upper coolant jacket 62 is located on the side of the exhaust gas lines which lies opposite the lower coolant jacket 60. At least one connection 65 is provided between the lower coolant jacket 60 and the upper coolant jacket 62, which serves for the passage of coolant.

Coolant can flow out of the lower coolant jacket into the upper coolant jacket, and/or vice versa, via the at least one connection. In the present case, the connection is a perforation or throughflow duct which connects the lower coolant jacket to the upper coolant jacket and by which an exchange of coolant between the two coolant jackets is made possible and is implemented.

Additional cooling of the cylinder head also takes place as a result. In this case, the coolant flow carried through the at least one connection contributes to the dissipation of heat. In particular, by an appropriate dimensioning of the cross section of the at least one connection, influence can be exerted deliberately upon the flow velocity of the coolant in the connection, and consequently upon the dissipation of heat in the region of this at least one connection.

The cooling of the cylinder head may additionally and advantageously be increased by a pressure drop that is generated between the upper and the lower coolant jacket, as a result of which, in turn, the velocity in the at least one connection is increased, thus leading to increased heat transfer as a result of convection.

Embodiments of the internal combustion engine are in this case advantageous in which the at least one connection is arranged at a distance from the exhaust gas lines in an outer wall of the cylinder head, from which outer wall at least one common exhaust gas line emerges.

At least one connection is consequently arranged in the cylinder head on the side of the exhaust gas lines which faces away from the cylinders. The at least one connection is therefore located as it were outside the exhaust manifold.

Embodiments are advantageous in which the lower and the upper coolant jacket are not connected to one another over the entire region of the outer wall, but, instead, the at least one connection extends only over a partial region of the outer wall. The flow velocity in the at least one connection can thereby be increased, thus increasing the heat transfer by convection. This also affords advantages with regard to the mechanical strength of the cylinder head.

Embodiments of the cylinder head are advantageous in which the distance between the at least one connection and the common exhaust gas line is smaller than the diameter, preferably smaller than half the diameter of a cylinder, the distance being calculated from the clearance between the outer wall of the overall exhaust gas line and the outer wall of the connection.

Embodiments of the internal combustion engine are advantageous in which the at least one connection is integrated completely in the outer wall. This embodiment is distinguished, for example, from forms of construction in which the outer wall has provided in it an orifice which serves for the supply or discharge of coolant into and out of the upper and the lower coolant jacket. Such an orifice does not constitute a connection in the present sense.

In this case, the at least one connection may perfectly well, within the scope of manufacture of the head, temporarily be open outwardly via an access orifice, for example for the removal of a sand core. However, the finished cylinder head then has, according to the version in question, at least one connection integrated completely in the outer wall, for which purpose a connection access provided if appropriate may be closed.

Basically, however, embodiments are also possible in which coolant supply or coolant discharge takes place in the region of the at least one connection, for which purpose a duct (not shown) branches off from the at least one connection and emerges from the outer wall.

The cooling arrangement may reliably protect the internal combustion engine, in particular the cylinder head 12, against thermal overloading, and may preferably be efficient enough that an enrichment ($\lambda<1$) at high exhaust-gas temperatures can be dispensed with.

As shown in FIG. 1, turbine 72 is coupled to cylinder head 12 on an outside of the cylinder head 12. However, in some embodiments, turbine 72 may be integrated in cylinder head 12. In order to provide a cooling mechanism to cool turbine 72, a coolant jacket 74 may be integrated in the housing of turbine 72.

Internal combustion engines are often equipped with a turbine or a plurality of turbines in order to utilize the exhaust gas enthalpy of the hot exhaust gases in exhaust gas turbocharging for the purpose of compressing the charge air. To this effect, the exhaust gas is supplied via a flow duct to a rotor mounted rotatably on a shaft, that is to say, is led through the turbine casing. The exhaust gas stream expands so as to emit energy in the turbine, which means that the shaft is set in rotation, thus driving the compressor which is likewise arranged on the shaft.

Without cooling being provided, the production costs for the turbine are comparatively high, since the often nickel-containing material then used for the thermally highly loaded turbine casing is cost-intensive, particularly in comparison with the material, to be precise aluminum, preferably used for the cylinder head. Not only the material costs as such, but also the costs of machining these materials are high.

Purely in terms of costs, it would be advantageous to manufacture the turbine from a less heat-resistant material. Use of aluminum would in this case also be beneficial in terms of the weight of the turbine.

In internal combustion engines which are equipped with a turbine for utilizing the enthalpy of the hot exhaust gases, said turbine having a turbine casing and at least one flow duct carrying the exhaust gas through the casing, embodiments are advantageous in which the at least one coolant jacket comprises at least one coolant jacket integrated in the turbine casing and the at least one exhaust gas-carrying line comprises at least one flow duct.

This embodiment implements the procedure according to the disclosure for improving cooling on a liquid-cooled turbine of the internal combustion engine and consequently takes account of the fact that, in supercharged internal combustion engines, not only is the cylinder head a thermally and mechanically highly loaded component, but also the turbine. Efficient and optimized cooling of the turbine casing makes it possible to use for producing the turbine materials which are capable of withstanding less thermal load.

A liquid-cooled turbine is especially advantageous in turbocharged internal combustion engines which are subjected to an especially high thermal load on account of the higher exhaust gas temperatures. Boosting an engine by a turbocharger serves primarily for increasing the power of the internal combustion engine. The air for the combustion process is in this case compressed, with the result that a larger air mass can be supplied to each cylinder per work cycle. The fuel mass and consequently the average pressure can thereby be increased.

Turbocharging is a suitable method for increasing the power of an internal combustion engine, with the cubic capacity remaining unchanged, or for reducing the cubic capacity, with the power remaining the same. In any event, boosting leads to an increase in construction space efficiency and a more beneficial power per unit mass. With vehicle boundary conditions being the same, the load collective can thus be displaced toward higher loads where specific fuel consumption is lower. This consequently assists the constant endeavor, in the development of internal combustion engines, to minimize the fuel consumption, and increase the efficiency of the internal combustion engine.

As compared with a mechanical charger, the advantage of an exhaust gas turbocharger is that there is no mechanical connection for the transmission of power between the charger and the internal combustion engine. While a mechanical charger obtains the energy for its drive directly from the internal combustion engine, the exhaust gas turbocharger utilizes the exhaust gas energy of the hot exhaust gases.

The turbine may be designed in a radial type of construction or axial type of construction, that is to say the flow onto the moving blades takes place essentially radially or axially. Essentially radially in this case means that the velocity component in the radial direction is greater than the axial velocity component.

The turbine may be equipped with variable turbine geometry which allows closer adaptation to the respective operating point of the internal combustion engine by the adjustment of the turbine geometry or the effective turbine cross section. In this case, movable guide vanes for influencing the flow direction are arranged in the inlet region of the turbine. In contrast to the moving blades of the rotating rotor, the guide vanes do not rotate with the shaft of the turbine. If the turbine has a fixed invariable geometry, the guide vanes are arranged in a stationary manner, but are also arranged completely immovably in the inlet region, that is to say affixed rigidly. If, by contrast, a turbine with variable geometry is used, the guide vanes are arranged stationary, but are not completely immovable, instead being rotatable about their axis, so that the flow onto the moving blades can be influenced.

The embodiments of the internal combustion engine are advantageous in which the cylinder head is equipped with liquid cooling and the turbine with liquid cooling and the two liquid cooling systems are connected to one another. Thus, the coolant jackets 60, 62, 74 may be included together in one coolant circuit. However, in some embodiment, they may be included in separate coolant circuits. While additional components of the coolant circuit are not depicted in FIG. 1, the coolant circuit may include a pump, heat exchanger, thermostat, etc. In one embodiment, the liquid coolant may include water, while in other embodiments the liquid coolant may include any suitable liquid.

Turning to FIG. 2, the engine 10 described with reference to FIG. 1 is depicted. Here, multiple cylinders of engine 10 are shown. In addition to cylinder 16, cylinders 66, 67, and 69 are depicted. While engine 10 is here depicted as a four-cylinder engine, it is to be understood that any number of cylinders in any arrangement is within the scope of this disclosure.

An intake manifold 68 provides intake air to the cylinders via intake passages, such as intake passage 24. After combustion, exhaust gasses exit the cylinders via exhaust lines, such as exhaust line 26, to the exhaust manifold 70. The exhaust lines of at least two cylinders may be merged to form an overall exhaust line within the cylinder head, so as to form an integrated exhaust manifold that permits the densest possible packaging of the drive unit. The exhaust gasses may pass through one or more aftertreatment devices 76 via an overall exhaust passage before exiting to the atmosphere.

The engine 10 may be boosted by an exhaust-gas turbocharger. The exhaust gas may pass through a turbine 72 to drive a compressor 75 to provide boosted intake air to engine 10. The turbine 72 may be coupled to the compressor by a shaft 73.

In internal combustion engines with a liquid-cooled cylinder head having at least one cylinder, in which each cylinder has at least one outlet port for discharging the exhaust gases from the cylinder and an exhaust gas line adjoins each outlet port, as was already stated initially, embodiments are advantageous in which the at least one coolant jacket comprises at least one coolant jacket integrated in the cylinder head and the at least one exhaust gas-carrying line comprises at least one exhaust gas line.

This embodiment implements the procedure according to the disclosure for improving cooling on a liquid-cooled cylinder head of the internal combustion engine and consequently takes account of the fact that the cylinder head is a thermally and mechanically highly loaded component which requires optimized cooling. With regards the locally limited regions which are subjected to an especially high thermal load and are therefore suitable for the introduction of a surface structure, reference is made to the statements already given in connection with a liquid-cooled cylinder head.

In a liquid-cooled cylinder head with at least two cylinders, embodiments are advantageous in which the exhaust gas lines of at least two cylinders converge into at least one common exhaust gas line so as to form at least one integrated exhaust manifold inside the cylinder head.

A cylinder head with an integrated exhaust manifold, in which exhaust gas lines converge inside the cylinder head, is subjected to an especially high thermal load, and therefore the cooling of a cylinder head of this type may satisfy stringent requirements. The design according to the disclosure of the boundary wall with a locally limited surface structure advantageously increases the cooling, as described in more detail with regard to FIG. 3.

The integration of the manifold takes place not only in order to implement a compact type of construction of the internal combustion engine. Downstream of the manifold, the exhaust gases are often supplied to the turbine of an exhaust gas turbocharger and/or to one or more exhaust gas retreatment systems. In this case, on the one hand, the endeavor is to arrange the turbine as near as possible to the outlet of the cylinders, so that the exhaust gas enthalpy of the hot exhaust gases can be optimally utilized and so as to ensure a rapid response behavior of the turbocharger. On the other hand, the path of the hot exhaust gases to the various exhaust gas retreatment systems is also to be as short as possible, so that the exhaust gases are given little time for cooling and the exhaust gas retreatment systems reach their operating temperature or light-off temperature as quickly as possible, especially after a cold start of the internal combustion engine.

In this respect, the aim is to minimize the thermal inertia of the portion of the exhaust gas line between the outlet port at the cylinder and the exhaust gas retreatment system or between the outlet port at the cylinder and the turbine, and this can be achieved by reducing the mass and length of this portion. Integrating the exhaust manifold into the cylinder head is in this case considered to be expedient.

Cylinder heads with, for example, four cylinders arranged in series, in which the exhaust gas lines of the external cylinders and the exhaust gas lines of the internal cylinders converge in each case into one common exhaust gas line, are cylinder heads of the type in question. Likewise are cylinder heads with three cylinders, in which only the exhaust gas lines from two cylinders converge into one common exhaust gas line so as to form an exhaust manifold inside the cylinder head.

Embodiments of the cylinder head in which the exhaust gas lines of all the cylinders of the cylinder head converge into a single, that is to say one common exhaust gas line or passage, inside the cylinder head are also advantageous.

Embodiments of the cylinder head are basically advantageous in which each cylinder has at least two outlet ports for discharging the exhaust gases from the cylinder. While the exhaust gases are being expelled during the charge change, it is a preeminent aim to release flow cross sections which are as large as possible as quickly as possible, in order to ensure an effective discharge of the exhaust gases, and therefore it is advantageous to provide more than one outlet port.

FIG. 3 shows a diagrammatic illustration of a detail of the liquid cooling arrangement of a first embodiment of the internal combustion engine. Within the scope of the present disclosure, the term "internal combustion engine" comprises diesel engines and gasoline engines, but also hybrid internal combustion engines, that is to say internal combustion engines which are operated by means of a hybrid combustion method.

The internal combustion engine has an exhaust gas-carrying line 26. To implement the liquid cooling, a coolant jacket 62 is provided, the exhaust gas-carrying line 26 and the coolant jacket 62 being separated from one another by a common boundary wall 64.

To increase heat transfer, the common boundary wall 64 is provided on sides of the coolant jacket 62, in a locally limited region, with a surface structure 78. To form the surface structure 78, an element 80 projects from the common boundary wall 64 into the coolant jacket 62. The element 80 is designed to be flattened with a flattened end face at its free end projecting into the coolant jacket 62 and has a radius of curvature in the foot region, that is to say at its end which lies opposite the free end which merges into the boundary wall 64.

Boundary walls are conventionally designed to be even, that is to say are provided with a smooth surface on the coolant side. There are several reasons for this. Owing to the smooth surface of the boundary walls, or the inner walls, the pressure loss in the coolant flow when it flows through the coolant jacket is to be kept as low as possible. A laminar coolant flow without turbulences is preferably to be formed. In this regard, there is also the endeavor to avoid sharp edges and wall portions projecting into the coolant jacket and also frequent and pronounced changes in direction of the coolant flow.

The smooth surfaces of the boundary walls and the further design criteria listed above also allow for the fact that coolant jackets are usually formed by sand cores in the casting method, specifically in one piece with the component into which they are integrated.

In the internal combustion engine according to the disclosure, the at least one boundary wall is designed to be locally uneven contrary to the conventional design walls. In the regions where a surface structure is provided, cooling is intensified, as described, and therefore the risk of coolant evaporation or of overheating is minimized. Since there is not generally any risk of thermal overloading in the entire coolant jacket, but only separately at critical locations which are subjected to an especially high thermal stress, according to the disclosure the entire boundary wall is also not provided on sides of the coolant jacket with a surface structure, but, instead, only locally limited regions which require intensified cooling. The background to this procedure is that regions subjected to less thermal load are to be cooled no more than is necessary, because the efficiency of the internal combustion engine decreases with increasing cooling, that is to say increasing heat extraction.

For the abovementioned reasons, in particular, embodiments of the internal combustion engine are advantageous in which the at least one locally limited region is a thermally highly loaded region. Thermally highly loaded regions are often regions where an exhaust gas flow is deflected or a plurality of exhaust gas flows are brought together.

In a cylinder head, particularly in a cylinder head with an integrated exhaust manifold, for example, the region where exhaust gas lines issue into one common exhaust gas line and hot exhaust gas is collected is subjected to an especially high thermal load.

On the one hand, a larger exhaust gas quantity passes such a collecting location of the exhaust gas system than an individual exhaust gas line, for example an exhaust gas line which follows the outlet port of a cylinder and is acted upon only with the exhaust gas or part of the exhaust gas of a cylinder. That is say, the quantity of exhaust gas which transmits or can transmit heat to the cylinder head is greater in the region of a collecting location.

On the other hand, a region of issue of exhaust gas lines into one common exhaust gas line is acted upon with hot exhaust gases for a longer time. Thus, the overall exhaust gas line of an integrated exhaust manifold is permanently acted upon with hot exhaust gases, whereas the exhaust gas lines of an individual cylinder, for example in a four-stroke internal combustion engine, have hot exhaust gas flowing through them only during the charge change of the respective cylinder, that is to say once within two crankshaft revolutions.

Furthermore, it may be taken into consideration that, in the region of a collecting location, the exhaust gas flows of the individual exhaust gas lines have to be deflected to a greater or lesser extent so that the exhaust gas lines can be brought together into one common exhaust gas line. In this region, therefore, the individual exhaust gas flows have at least partially a velocity component which is perpendicular to the walls of the exhaust gas line, with the result that heat transfer by convection and consequently the thermal load upon the cylinder head, that is to say the boundary wall, are increased locally at this point. For the reasons mentioned, it is therefore advantageous to provide the boundary wall with a surface structure at least in the region where exhaust gas lines converge or an exhaust gas-carrying line has a bend.

Returning to FIG. 3, it can be seen that the surface structure 78 has a height h which indicates the spatial extent, perpendicular to the boundary wall 64, of the structure 78 or element 80 into the coolant jacket 62.

This embodiment also shows that the surface structure according to the disclosure has a spatial extent, in contrast to the even surface commonly found in boundary walls. The at least one element projecting from the boundary wall into the coolant jacket narrows the flow cross section of the coolant duct, with the result that the flow velocity and consequently the heat transfer increase in a locally limited manner. The flow breaks away from the wall delimiting the coolant jacket and changes from a laminar to a turbulent flow. This, too, increases the heat transfer.

Although a breakaway of the flow from the boundary wall affords advantages, the at least one element preferably has a radius of curvature in the foot region, that is to say at its end which lies opposite the free end and merges into the boundary wall. This embodiment takes account of the fact that the coolant jacket and therefore the element are usually formed in the casting method, using sand cores or the like.

While a coolant jacket positioned adjacent to an exhaust line in a cylinder head is depicted in FIG. 3, the coolant jacket could be any coolant jacket in the engine, for example a coolant jacket integrated into a turbine casing of a turbocharger turbine as described above with respect to FIG. 1. In such cases, the surface structure 78 and elements 80 may be utilized as described to reduce the thermal load in highly loaded regions.

FIG. 4 shows a perspective illustration of a detail in the coolant jacket 62 of the liquid cooling arrangement illustrated in FIG. 3. It is intended merely to be in addition to FIG. 3, and therefore reference is otherwise made to FIG. 3. The same reference symbols were used for the same components.

As may be gathered from FIG. 4, to form a knob-like surface structure 82, three knob-shaped elements 84 are provided which are arranged at a distance from one another and project from the common boundary wall 64 into the coolant jacket 62. The knobs 84 have a round circular cross section.

Knobs fulfill in an advantageous way the conditions imposed upon the at least one element, to be precise that of increasing the heat-transmitting area, without overly reducing the flow cross section of the coolant duct. Furthermore, knobs have a geometric form which is suitable for production by the casting method. The latter is advantageous particularly since the component receiving the coolant jacket is usually produced in one piece as a casting. A knob has a form suitable for this production method.

Embodiments are advantageous in which the at least one knob-shaped element has a round, in particular circular or elliptic cross section. The cross section may have no corners for manufacturing reasons, so that the form can be produced in a satisfactory quality by the casting method. Moreover, it may be taken into account that the knob-shaped element itself is a structural element subjected to high thermal stress, and therefore the knob may have no portions of very small material thickness, as a polygonal knob would.

FIG. 5 shows a perspective illustration of a detail of the coolant jacket 62 of a second embodiment of the liquid cooling. Only the differences from the embodiment illustrated in FIG. 4 will be discussed, and therefore reference is otherwise made to FIG. 4. The same reference symbols were used for the same components.

In contrast to the embodiment illustrated in FIG. 4, in the version illustrated in FIG. 5 the surface structure is of rib-like design. The rib-shaped element 86 which projects from the boundary wall 64 into the coolant jacket 62 has a cross section of a basic rectangular form which is rounded at the corners for manufacturing reasons.

The embodiment of an element 86, as illustrated in FIG. 5, is a limiting case and may likewise be considered and designated as knobs of essentially rectangular cross section.

By use of a rib form of the element, the heat-transmitting area can be markedly increased in a locally limited region by the use of a small amount of material. What was said with regard to the knob-shaped element applies in a similar way. The cross section of the rib-shaped element is preferably rounded at the corners for manufacturing reasons.

FIG. 6 shows a top view of the sand core 88 of the exhaust gas lines integrated into a cylinder head of the internal combustion engine and therefore basically also the exhaust gas lines (such as 26) integrated in the cylinder head, that is to say the exhaust manifold 70 integrated in the cylinder head 12, therefore the reference symbols for the exhaust gas lines 26 or for the manifold 70 are also inscribed.

The sand core 88 for the exhaust gas system illustrated in FIG. 6 comprises the exhaust gas lines 26 of a four-cylinder inline engine. Each of the four cylinders is equipped with two outlet ports, an exhaust gas line adjoining each outlet port. The exhaust gas lines of the cylinders converge inside the cylinder head into one common exhaust gas line, which emerges (not illustrated) downstream from an outer wall of the cylinder head.

Some thermally highly loaded regions 90*a*, 90*b* are indicated by way of example. Regions which are thermally highly loaded include those regions 90*b* in which the exhaust gas flows are deflected, such as when the exhaust line is bent, or a plurality of exhaust gas flows are brought together. In one embodiment, such deflection regions 90*b* may be defined as areas of the exhaust lines where the exhaust flow deflects off the sides of the exhaust lines rather than flowing in a direction substantially parallel to the exhaust lines.

In a cylinder head with an integrated exhaust manifold, for example, the collecting region where exhaust gas lines converge into one common exhaust gas line and hot exhaust gas is collected is subject to an especially high thermal load. These confluence regions 90*a* are therefore especially predestined to be provided with a surface structure for the purpose of improving the cooling. Confluence regions 90*a* may be regions immediately surrounding an area where one or more exhaust lines merge together.

The elements that are included in the surface structure may protrude into the coolant jacket any suitable amount that provides maximal heat transfer yet minimizes flow restriction. For example, the elements may protrude into the coolant jacket such that the height of the elements comprises 10% of the diameter of the coolant jacket. In other embodiments, the height of the elements may be 5% of the coolant jacket. Embodiments of the internal combustion engine are advantageous in which the surface structure, whether the surface structure is of knob-like or rib-like design, has a height of less than 7 millimeters, preferably of less than 4 millimeters, the height indicating the spatial extent, perpendicular to the boundary wall, of the structure into the coolant jacket. By limiting the spatial extent of the surface structure, restriction of the coolant flow within the coolant jacket can be limited while still taking advantage of the heat-transfer benefits of the elements of the surface structure.

Additionally, the spacing of the elements may be optimized with regard to the dimensions of the coolant jacket. For example, the elements may spaced apart from each other by an amount equal to twice the diameter of the cross-section of each element, or they may be spaced by an amount equal to the diameter of the cross-section. In some embodiments, the elements may be sized and/or spaced differently in different regions. For example, confluence regions may experience higher thermal loading than deflection regions, and as such, the elements in the confluence region may be sized larger than the elements in the deflection region. Any sizing and spacing of the elements that balances heat transfer and flow restriction is within the scope of this disclosure.

Thus, the sand core of FIG. 6 may provide a method of generating a liquid cooling arrangement of a cylinder head. In one embodiment, such a method may include generating a sand core including indentations positioned in a plurality of locations along at least one side of the sand core, and casting the cylinder head with the sand core such that a coolant jacket is integrated in the cylinder head, at least one wall of the coolant jacket having elements projecting into the coolant jacket only in regions of high thermal loading as a result of the indentations in the sand core.

FIG. 7 shows an example method 100 for reducing thermal load in a cylinder head according to an embodiment of the present disclosure. Method 100 comprises, at 102, providing exhaust lines in a cylinder head. When a cylinder head is cast, the internal structures may be provided by sand cores, which are removed after casting, leaving the hollow structures in their place. The exhaust lines are one example of an internal structure in a cylinder head. As explained previously, the exhaust lines may have local regions of high thermal loading, such as confluence regions where multiple exhaust lines join together. At 104, method 100 comprises providing coolant jackets in the cylinder head. The coolant jackets may be positioned within the cylinder head adjacent to the exhaust lines, such that the exhaust lines and coolant jackets are separated by one or more boundary walls. At 106, the thermal load of the cylinder head is reduced. Reducing the thermal load of the cylinder head includes positioning elements along the boundary walls in the afore-mentioned identified regions of high thermal loading at 108. The elements are positioned along the boundary wall and protrude into the coolant jacket.

At 108, method 100 includes routing coolant through the coolant jackets and in doing so, passing the coolant by the elements. In this way, the exhaust lines and adjacent coolant jackets may be provided within the cylinder head. The protruding elements positioned along the boundary walls between the exhaust lines and coolant jackets project into the coolant jackets at the regions of high thermal loading. In this way, the elements may provide additional heat transfer from the wall to the coolant to aid in reducing the thermal load in these regions. While method 100 describes generating a cylinder head to reduce thermal load in the cylinder head, a similar method may be used to reduce thermal load in other components of the engine, such as a turbine.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An internal combustion engine with liquid cooling, comprising:

at least one exhaust gas line;

at least one coolant jacket;

a common boundary wall separating the at least one exhaust gas line and the at least one coolant jacket, wherein the common boundary wall includes a surface structure provided on sides of the coolant jacket in at least one locally limited region, and a turbine including a turbine casing for utilizing enthalpy of hot exhaust gases, the turbine including at least one flow duct for carrying the exhaust gas through the casing, wherein the at least one coolant jacket comprises at least one coolant jacket integrated in the turbine casing and the at least one exhaust gas line comprises the at least one flow duct, wherein the surface structure includes at least one knob-shaped element, the at least one knob-shaped element projecting from the common boundary wall into the at least one coolant jacket.

2. The internal combustion engine as claimed in claim 1, wherein at least one locally limited region is a thermally loaded region.

3. The internal combustion engine as claimed in claim 1, further comprising:

a liquid-cooled cylinder head having at least one cylinder, each cylinder including at least one outlet port for discharging the hot exhaust gases from the cylinder, each outlet port adjoining an exhaust gas line; and wherein the at least one coolant jacket comprises at least one coolant jacket integrated in the cylinder head.

4. The internal combustion engine as claimed in claim 3, wherein the liquid-cooled cylinder head comprises at least two cylinders, wherein exhaust gas lines of the at least two cylinders converge into at least one common exhaust gas line so as to form at least one integrated exhaust manifold inside the cylinder head.

5. The internal combustion engine as claimed in claim 4, wherein the liquid-cooled cylinder head is connectable to a cylinder block on a mounting end face, and wherein the at least one coolant jacket comprises:

at least one lower coolant jacket integrated in the cylinder head and arranged between exhaust gas lines and a mounting end face of the cylinder head; and at least one upper coolant jacket integrated in the cylinder head and arranged on a side of the exhaust gas lines which lies opposite the lower coolant jacket.

6. The internal combustion engine as claimed in claim 5, wherein at least one connection is arranged at a distance from the exhaust gas lines in an outer wall of the cylinder head, from which outer wall at least one common exhaust gas line emerges.

7. The internal combustion engine as claimed in claim 6, wherein the at least one connection is integrated completely in the outer wall.

8. The internal combustion engine as claimed in claim 1, wherein, to form the surface structure, at least one element projects from the common boundary wall into the at least one coolant jacket.

9. The internal combustion engine as claimed in claim 8, wherein, to form the surface structure, at least two elements arranged at a distance from one another project from the common boundary wall into the coolant jacket.

10. The internal combustion engine as claimed in claim 1, wherein the at least one knob-shaped element has a round, circular, or elliptic cross section.

11. The internal combustion engine as claimed in claim 1, wherein the surface structure includes at least one rib-shaped element, the at least one rib-shaped element projecting from the common boundary wall into the at least one coolant jacket.

12. The internal combustion engine as claimed in claim 1, wherein the surface structure has a height of less than 7 millimeters, the height indicating a spatial extent, perpendicular to the boundary wall, of the surface structure into the at least one coolant jacket.

13. The internal combustion engine as claimed in claim 1, wherein the surface structure has a height of less than 4 millimeters, the height indicating a spatial extent, perpendicular to the boundary wall, of the surface structure into the at least one coolant jacket.

14. A method for cooling a cylinder head, comprising:

providing a coolant jacket in the cylinder head, the coolant jacket separated from at least one exhaust line by a boundary wall; and providing a plurality of elements projecting from the boundary wall into the coolant jacket, the plurality of elements positioned along the boundary wall only in confluence regions of the coolant jacket.

15. The method of claim 14, wherein thermally loaded regions comprise one or more of regions of the coolant jacket adjacent to where at least two exhaust lines merge and regions of the coolant jacket adjacent to bends in the at least one exhaust line.

16. The method of claim 14, wherein the elements are knob-shaped in order to maximize a heat-transfer area of the elements and minimize coolant flow restriction in the coolant jacket.

17. The method of claim 14, wherein the elements are rib-shaped in order to maximize a heat-transfer area of the elements.

18. A system for reducing thermal loading, comprising:

a cylinder head including a plurality of exhaust lines, the plurality of exhaust lines merging together in one or more confluence regions;

an exhaust manifold integrated into the cylinder head and coupled to the plurality of exhaust lines;

a coolant jacket integrated in the cylinder head and separated from the plurality of exhaust lines by one or more boundary walls; and at least one element positioned only on sides of the one or more boundary walls that face into the coolant jacket, the at least one element located only in the one or more confluence regions.

* * * * *